US005502851A

United States Patent [19]

Costello

[11] Patent Number: 5,502,851

[45] Date of Patent: Apr. 2, 1996

[54] ASSISTED LIFTING, STAND AND WALKING DEVICE

[76] Inventor: Martin D. Costello, 1136 St. Julian Dr., Chesapeake, Va. 23323

[21] Appl. No.: 249,717

[22] Filed: May 26, 1994

[51] Int. Cl.[6] ..... A61G 7/10

[52] U.S. Cl. ..... 5/86.1; 5/89.1; 482/69

[58] Field of Search ..... 5/86.1, 83.1, 81.1, 5/89.1; 605/241; 602/36; 128/883; 482/66–69; 2/69, 308, 314–320

[56] References Cited

U.S. PATENT DOCUMENTS

| | | | |
|---|---|---|---|
| 1,268,932 | 6/1918 | Corrigan | 602/36 |
| 1,611,807 | 12/1926 | Bergh . | |
| 2,719,568 | 10/1955 | Webb | 2/69 |
| 2,854,000 | 9/1958 | Anderson | 602/36 |
| 2,903,238 | 9/1959 | Flandrick | 5/83.1 |
| 2,962,730 | 12/1960 | Carnes | 5/86.1 |
| 3,252,704 | 5/1966 | Wilson | 482/69 |
| 3,711,877 | 6/1973 | Averill | 5/81.1 |
| 3,778,052 | 12/1973 | Andow et al. . | |
| 4,280,578 | 7/1981 | Perkins . | |
| 4,557,257 | 12/1985 | Fernandez et al. . | |
| 4,649,581 | 3/1987 | Lee | 5/81.1 |
| 4,802,542 | 2/1989 | Houston et al. . | |
| 4,865,022 | 9/1989 | Gorsen | 602/36 |
| 4,941,497 | 7/1990 | Prather et al. . | |
| 4,981,307 | 1/1991 | Walsh | 5/81.1 |
| 5,050,590 | 9/1991 | Futakami . | |
| 5,054,476 | 10/1991 | Petrofsky | 482/66 |
| 5,117,516 | 6/1992 | Penner | 5/86.1 |

FOREIGN PATENT DOCUMENTS

| | | | |
|---|---|---|---|
| 399836 | 11/1990 | European Pat. Off. | 5/86.1 |
| 820497 | 9/1959 | United Kingdom | 5/86.1 |

OTHER PUBLICATIONS

Rifton Brochure on Lift Walkers, "Stand Up and Walk Powered Lift Action & Supported Walking" (2 pgs., not dated).

Rifton Brochure on Rifton Gait Trainers, "Affordable Alternatives For Dignity and Independence" (2 pgs., not dated).

Arjo–Century Brochure on "Lift Walker 214141" (2 pgs., not dated).

Noonan, Peggy, "A Robot for Rehab", American Health, p. 10, Mar. 1994.

Soma Brochure on Zuni™ Exercise System, "Unloading 'Your Patients Don't Have Time for the Weight'", (2 pgs., not dated).

Abledata Brochure on "Patient Lifts", pp. 1–3, Fact Sheet 9, Apr. 1990.

Murray, Julie M. et al., Official Journal of the Cariopulmonary Section American Physical Therapy Association, "Cardiopulmonary Physical Therapy Journal, Determination of the Physiological Effects of Unloaded Treadmill Exercise", vol. 4, No. 2, 5 pgs., Spring, 1993.

*Primary Examiner*—Flemming Saether
*Attorney, Agent, or Firm*—Jones, Tullar & Cooper

[57] ABSTRACT

An assisting lifting, standing and walking device employs base side members whose rear track width is adjustable to facilitate use of the device to lift severly disabled, elderly or other physically challenged persons from a wheelchair, and then allow the overall device width to be reduced for passage through narrow doorways or other passageways. The device also employs a lifting mechanism which can be adjusted by means of a hydraulic jack over a wide range of positions to facilitate lifting of individuals from a prone position on the floor to a standing position. The lifting mechanism includes a pair of individually adjustable generally L-shaped lifting yoke arms that can be adjusted both vertically and angularly to accommodate individuals with posture conditions and provide selective weight bearing alleviation. A special full body harness is employed with the device which has long thigh wraps and a wide lumbar belt for widely distributing lifting pressure and reducing the risk of injury.

25 Claims, 4 Drawing Sheets

FIG. 4
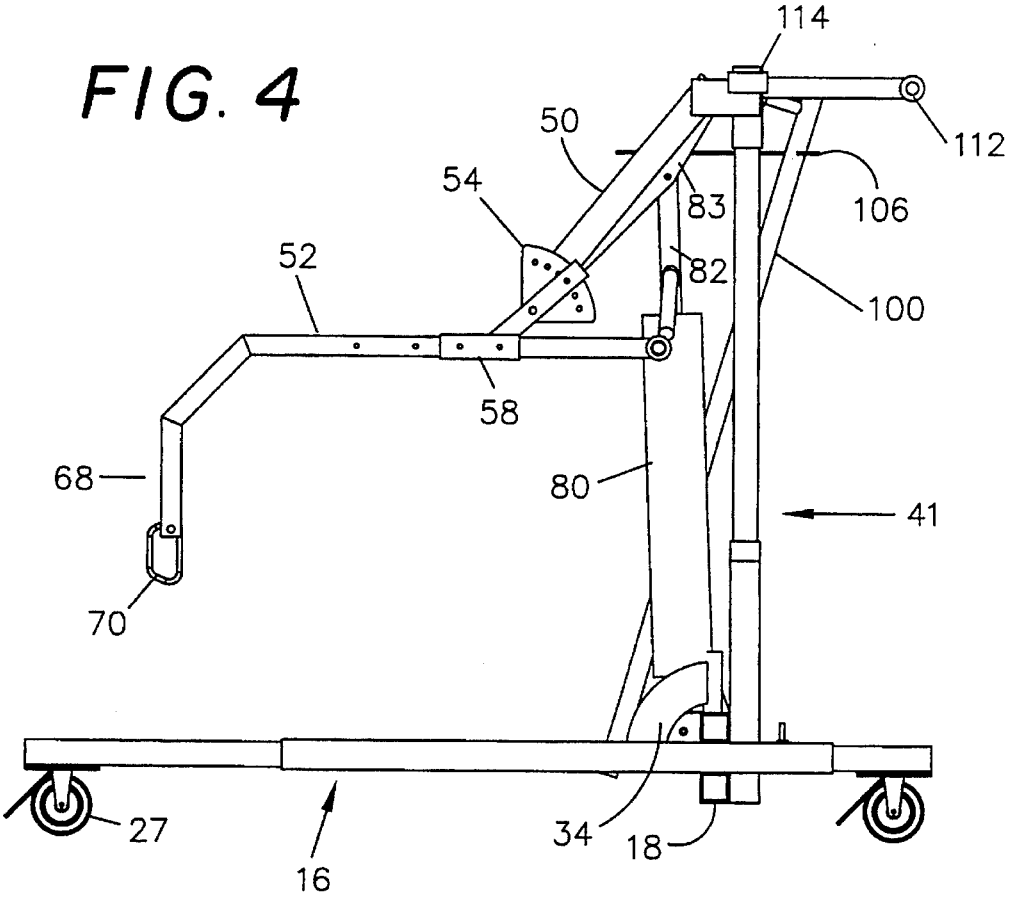
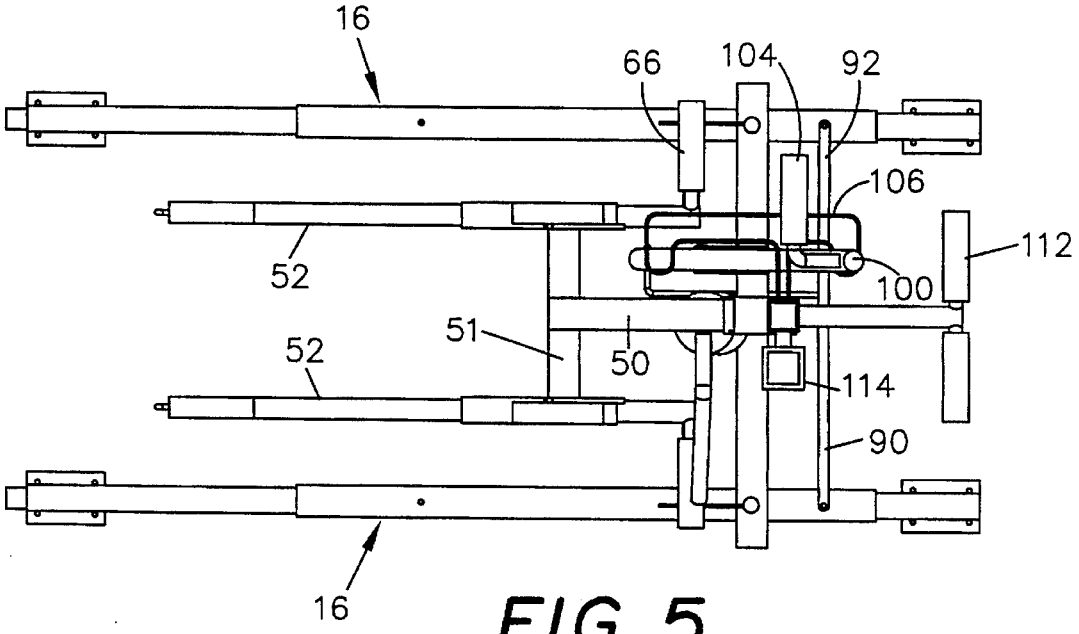
FIG. 5

ASSISTED LIFTING, STAND AND WALKING DEVICE

BACKGROUND OF THE INVENTION

The present invention relates in general to a modular, mobile lift apparatus for assisting severely disabled, elderly or other physically challenged persons or patients with standing, walking, rehabilitation or exercise. The present invention also assists care givers and therapists with patient lifting and weight bearing alleviation.

Twentieth century concepts on rehabilitation and general health maintenance of the physically challenged or disabled often include prolonged standing and/or walking. The physiological benefits of standing a walking are widely known and prescribed to those who can do so. Unfortunately, physically challenged or severely disabled individuals who are restricted to wheelchairs and/or beds, are rarely given the opportunity of attempting to stand or walk independently. Such attempts are sometimes avoided because the health of the individual is such that there is a fear of falling and receiving injury. Other times, the energy expenditures required to perform the task are too great for the individual or care giver. Often, the resulting liability risks for the care giver or health care provider are too great so that the activity is completely avoided to eliminate the risk.

In an attempt to solve these problems, numerous devices have been marketed which assist physically challenged or disabled individuals during walking. Some of these devices also include harness type supports, or the like, which hold the patient or individual securely and prevent them from falling. In addition, some walking devices include lifting mechanisms which enable an individual to be easily moved from a lying position in a bed or a sitting position in a wheelchair to a standing position in the walking device.

Unfortunately, these known walking and/or lifting devices suffer from a number of drawbacks. For example, when the mechanisms include means to lift an individual from a wheelchair to a standing position, the physical size of the device becomes so large that it is difficult to maneuver and cannot pass unobstructed through passageways that meet the minimum requirements of the Americans With Disabilities Act. Other known lifting devices often require larger stationary devices, such as overhead support frames or pivoting booms which require large rooms and limit device usage and availability. Others employ "lean to" type frames which are wide, limited in lifting range or do not lift at all and require the individual to have significant upper body strength. Finally, seat type lifts are uncomfortable during lifting and weight bearing removal is also dependent on the patient's strength.

SUMMARY OF THE INVENTION

The present invention seeks to overcome the drawbacks of the prior art devices through provision of an assisted lifting, standing and walking (ALSW) device which is both modular and adjustable to allow the device to be employed for individuals of different sizes and conditions to lift them from a bed, a wheelchair or the floor, while at the same time permitting passage of the device through narrow passageways while in use. In particular, the ALSW device includes a base frame including a pair of spaced side members which are pivotally mounted to opposite ends of a cross member so that each of the side members can pivot about a vertical axis. Casters are mounted to the side members which permit the base frame to roll freely. A lever and linkage mechanism is connected to the two side members that when actuated, causes the side members to pivot in opposite directions to adjust their rear track width over a wide range. In this manner, the rear ends of the side members can be spread apart to permit a wheelchair to be positioned between them for patient lifting and seating, and then moved toward one another to allow passage of the ALSW device through narrow passageways.

Connected to the base frame is an adjustable vertical frame which includes a vertical mast assembly having a boom member pivotally mounted at a first end thereto for movement about a horizontal axis. A lifting mechanism, such as a hydraulic jack, is attached to the boom member for causing the pivotal movement of the same.

Adjustably attached to a second end of the boom member are first and second lifting yoke arms, each of which can be individually adjusted both vertically and angularly about a horizontal axis. Each of the yoke arms is generally L-shaped and includes a bottom end to which a horizontally positioned handle is attached for supporting a user's hand, and a top end to which a depending hook is attached.

A specially designed full body harness is employed with the device which is designed to be placed on an individual while in a wheelchair or bed, or on the floor. The body harness includes a pair of adjustable shoulder "D" rings which are designed to be secured to the depending hooks on the yoke arms. The harness is equipped with specially designed thigh wraps which distribute the lifting pressure over a large area of the individual's thighs and avoid contact in the individual's groin area. A lower lumbar support is also provided with the body harness that not only distributes the lifting pressure to the individual's trunk, but also provides back support during utilization of the ALSW device.

During use of the ALSW device, the full body harness is first placed on the individual who wishes to use the device. The individual may be either sitting in a chair or wheelchair or lying on a bed or the floor. The ALSW device is then maneuvered as close as possible to the individual with the rear track width of the side members being adjusted as necessary to facilitate this. Next, the vertical position of the depending hooks on the lifting yoke arms is lowered enough to permit attachment of the body harness "D" rings thereto by releasing the hydraulic jack. The hydraulic jack is then actuated to elevate the individual to a standing position and unload any or all of a portion of their body weight if necessary. If the side members have been spread apart to facilitate loading from a wheelchair or bed, they are closed back toward one another so that the individual can now walk with the ALSW device through narrow passageways, such as doorways.

BRIEF DESCRIPTION OF THE DRAWINGS

The foregoing and other features and advantages of the present invention will become apparent from the following detailed description of a preferred embodiment thereof, taken in conjunction with the accompanying drawings in which

FIG. 4 is a side view of the preferred embodiment shown in a second position with the yoke arms fully lowered and the base side members parallel to each other;

FIG. 5 is a top view of the preferred embodiment shown in the second position;

DETAILED DESCRIPTION OF THE PREFERRED EMBODIMENT

Figure 1:
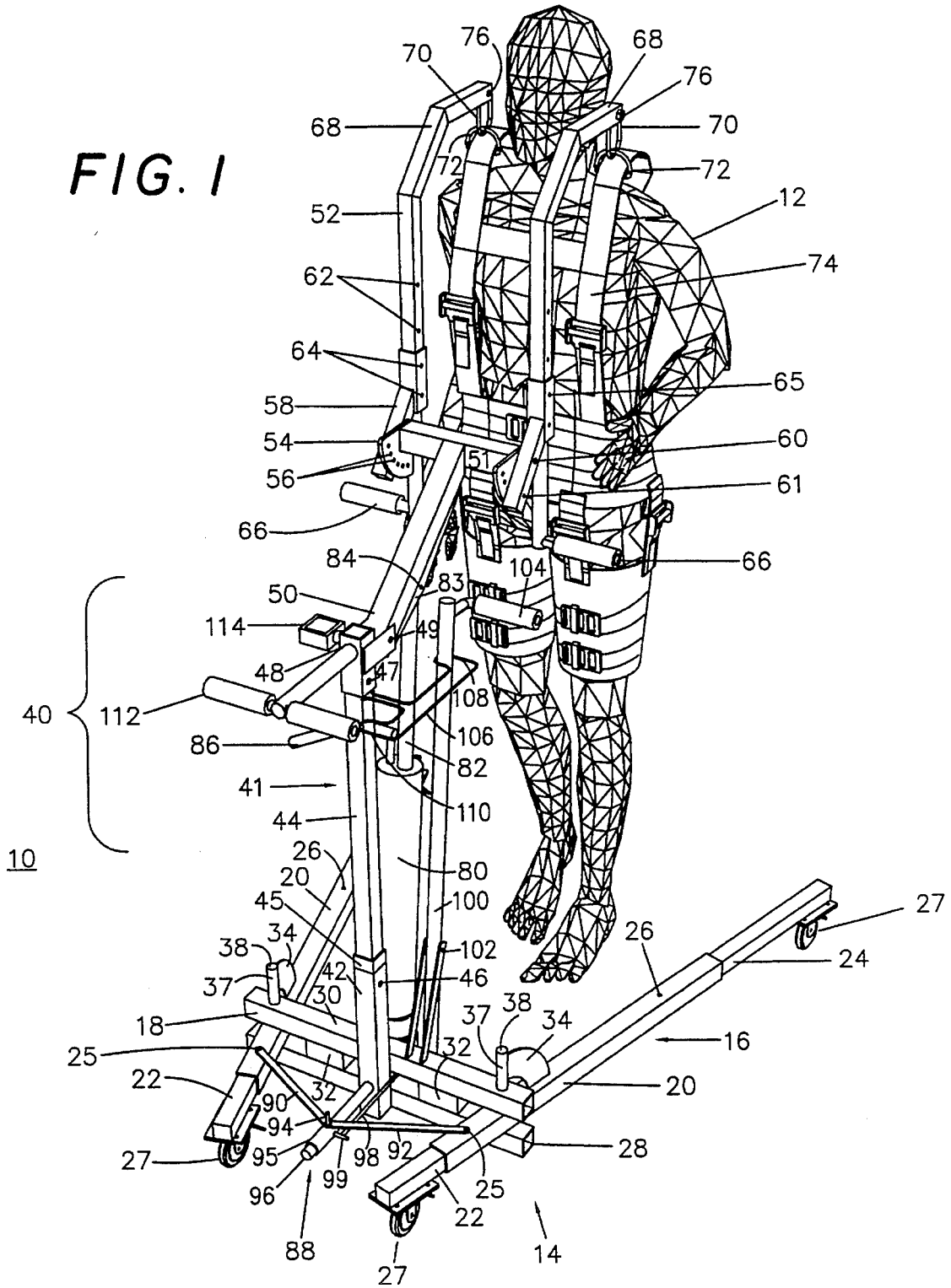
FIG. 1 is a front perspective view of a preferred embodiment of the present invention.

Turning now to a detailed consideration of a preferred embodiment of the present invention, FIG. 1 illustrates an assisted lifting, standing and walking (ALSW) device 10 for lifting an individual 12 from a prone or sitting position and assisting them in standing or walking. The ALSW device 10 includes a base frame 14 comprising first and second horizontal side members 16, each of which is pivotally mounted for movement about a vertical axis to opposite ends of a horizontal cross member 18.

Each of the horizontal side members 16 includes a middle sleeve 20, a front inner member 22 which is telescopically inserted in the front end of the middle sleeve 20, and a rear inner member 24 which is telescopically inserted into the back end of the middle sleeve 20. Each of the front inner members 22 is secured to the corresponding middle sleeve 20 by a removable bolt or quick-release pin 25 that passes vertically through apertures in the middle sleeve 20 and the front inner member 22. Similarly, each of the rear inner members 24 is secured to the corresponding middle sleeve 20 by means of a removable quick-release pin or bolt 26. Preferably, each of the rear inner members 24 has a plurality of spaced apertures (not shown) for reception of the bolt or pin 26 so that the exposed length of the inner member 24, and therefore the wheel base of the ALSW device 10, can be adjusted to a plurality (e.g. 3) of positions as desired.

Mounted on the bottom sides of each of the front and rear inner members 22 and 24 is a locking swivel caster wheel 27 which permits the ALSW device 10 to roll freely. Since each of the front and rear inner members 22 and 24 is telescopically inserted in the middle sleeve 20, they can be easily replaced by similar members having different casters or wheels for adapting the ALSW device 10 for use on all different types of terrain or surfaces. The overall combined height of the side member 16 and the caster wheels 27 is chosen to be less than approximately 9 inches, preferably 4–5 inches, so that the rear ends of the side members 16 can easily roll under either a conventional bed or a hospital bed to facilitate easy transfer of an individual between the bed and the ALSW device 10.

The horizontal cross member 18 comprises a bottom horizontal member 28 and a top horizontal member 30, both of which are spaced apart from one another in a parallel manner by a pair of spacer blocks 32. Each middle sleeve 20 of the side members 16 is received in the corresponding space between the ends of the bottom and top members 28 and 30 and is mounted to the top member 30 by means of a corresponding one of a pair of gussets 34. Each of the gussets 34 includes a first end which is welded to the top side of the middle sleeve 20 and a second, vertically positioned cylindrical sleeve end 37 which is secured to the top member 30 by means of a bolt or pin 38. This pivotal mounting arrangement for the side members 16 allows them to pivot freely relative to the cross member 18 without binding therewith. As illustrated best in FIGS. 3 and 5, the pivotal mounting of the side members 16 permits the distance between the rear inner members 24 (i.e., rear track width of the ALSW device 10) to be varied substantially so that they can be spread apart to facilitate loading and unloading of an individual from a wheelchair, and then moved toward one another to permit passage of the ALSW device 10 through narrow passageways, such as doorways. The means by which the side members 16 are pivotally adjusted will be discussed in greater detail below.

An adjustable vertical frame assembly 40 is welded or attached by any other suitable means to the base frame assembly 14. The vertical frame assembly 40 includes a vertical mast assembly 41 comprising a lower vertical mast member 42 which is attached at its bottom end to the cross member 18 of the base frame assembly 14, and an upper mast member 44 that is telescopically inserted into the upper end of the lower mast member 42. An upper mast stop sleeve 45 is welded to the upper mast member 44 which engages the upper end of the lower mast member 42 when the upper mast member 44 is inserted therein. A removable quick-release pin or bolt 46 is inserted through apertures in the lower and upper mast members 42 and 44 to secure the upper mast member 44. Attached to an upper end of the upper mast member 44 by means of a removable quick-release pin or bolt 47 is a boom bracket 48, to which is pivotally attached by a pin or bolt 49 for movement about a horizontal axis, a first end of a boom 50. Welded to a second end of the boom 50 is a horizontal cross member 51.

First and second generally L-shaped lifting yoke arms 52 are attached to opposite ends of the horizontal cross member 51 by means of a pair of bracket plates 54, one positioned at each end of the horizontal cross member 51. Each of the bracket plates 54 has a plurality of angularly spaced adjustment apertures 56 which facilitate angularly adjustable attachment of a pair of lifting yoke arm bracket sleeves 58, one mounted on each of the lifting yoke arms 52. Each of the yoke arm sleeve brackets 58 is pivotally mounted by means of a pivot bolt 60 to the horizontal cross member 51 for movement about the longitudinal axis of the cross member 51. A locking pin or bolt 61 is inserted in an aperture in the lower end of each of the bracket sleeves 58 which is lined up with and inserted in a corresponding one of the apertures 56 in the corresponding bracket plate 54 to secure each of the bracket sleeves 58 in the desired angular position.

The vertical position of each of the yoke arms 52 relative to the bracket sleeves 58 is adjustable by means of a plurality of apertures 62 in each of the yoke arms 52 and a pair of corresponding apertures 64 in each of the bracket sleeves 58. These are lined up with one another to receive a pair of locking pins 65, and thereby fix the vertical position of each of the yoke arms 52. It should be noted that the vertical and angular position of each of the yoke arms 52 can be adjusted independently of each other in the event that the individual 12 has a posture related condition which prevents them from standing straight or requires uneven adjustment of the yoke arms 52 for rehabilitation therapy.

Each of the yoke arms 52 has a bottom end, to which is attached or formed, a horizontal handle 66 for supporting the hands of the individual 12 and facilitating movement and steering of the ALSW device 10. The L-shaped yoke arms 52 also each include a top portion 68 from which depends, a hook 70 for attachment to an adjustable shoulder "D" ring 72 of a full body harness 74 that is worn by the individual 12. Each of the hooks 70 is attached to the end of the top portion 68 by means of a through bolt 76.

Figure 2:
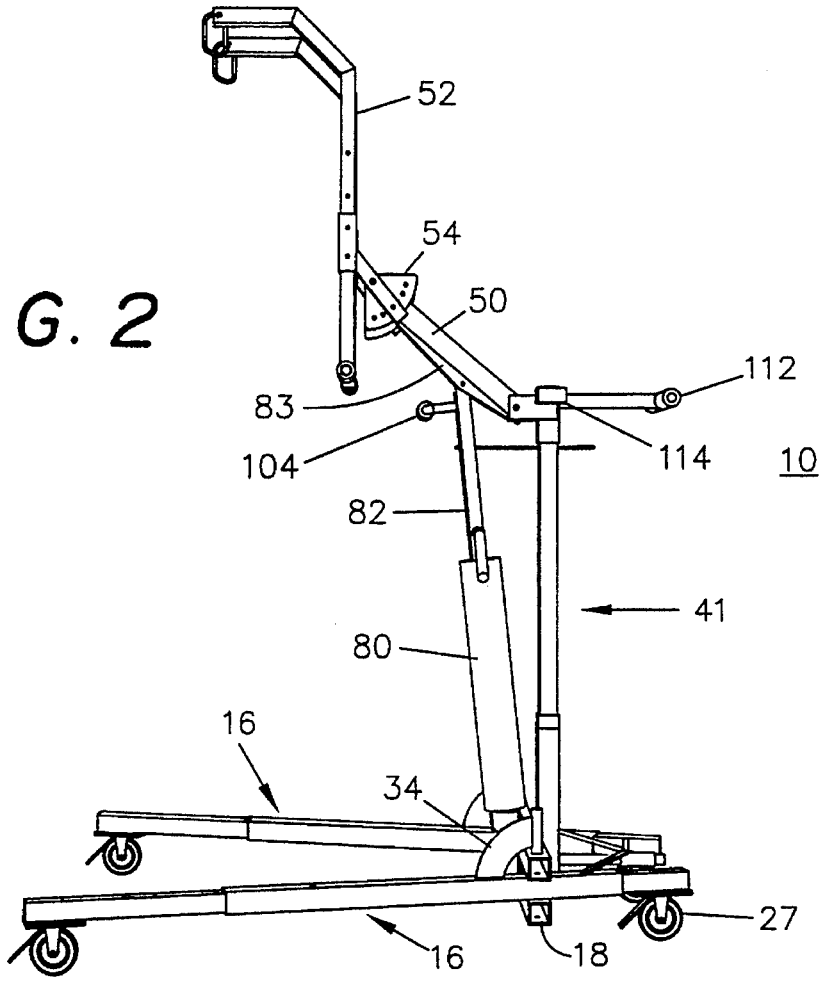
FIG. 2 is a side view of the preferred embodiment shown in a first position with the yoke arms fully raised and the base side members spread apart.

The angular position of the boom 50 is adjustable over a wide range of positions from a fully raised position as illustrated in FIGS. 1 and 2 where the hooks 70 on the yoke arms 52 are at their highest vertical position approximately several inches above the shoulders of the individual 12 when they are in a standing position, to a fully lowered position as illustrated in FIG. 4 where the yoke arms 52 are lowered and simultaneously rotated through 90° so that the hooks 70 are at their lowest position approximately one foot or less above the surface on which the ALSW device 10 is placed. To facilitate this range of motion, a conventional hydraulic jack 80 is employed which is mounted at a bottom end to the base cross member 18 and has an extensible ram 82 connected at its top end near the middle of a pair of parallel gussets 83 on the underside of the boom 50 by means of a pin 84. An actuating handle 86 is employed to raise and lower the ram 82. It will be understood that the hydraulic jack 80 could be replaced with any other type of lifting mechanism, such as a motorized lifting mechanism, if desired. The ram 82 of the hydraulic jack 80 is preferably dampened so that if it accidentally releases when an individual is supported in the upright position by the body harness 74, the descent rate of the yoke arms 52 will be sufficiently slow to prevent injury to the individual.

The shape, positioning and adjustability of the L-shaped lifting yoke arms 52 is significant for a number of reasons. First, the distance between the yoke arms 52 as determined by the length of the cross member 51 is chosen to be wider than an individual's head so that they will not hit the individual's head when they are lowered. This distance is preferably approximately 8–12 inches. Second, the design avoids the need for any overhead lifting mechanism so that the ALSW device 10 can easily pass through low vertical clearance doorways, or the like. Finally, the vertical adjustability of yoke arms 52 enables the ALSW device 10 to be collapsed down to a low height when not in use for easy storage or transport.

To facilitate adjustment of the rear track width of the horizontal side members 16, an adjustment linkage generally indicated at 88 is provided. The adjustment linkage 88 includes first and second adjustment arms 90 and 92. The first adjustment arm 90 has a first end pivotally connected by means of the pin or bolt 25 to the top side of the middle sleeve 20 of a first one of the horizontal side members 16, and the second adjustment arm 92 has a first end pivotally connected by means of the pin or bolt 25 to the top side of the middle sleeve 20 of the second side member 16. The second ends of the adjustment arms 90 and 92 are connected to a vertical pin 94 on a sleeve 95. The sleeve 95 is slidably mounted for reciprocating movement on a guide shaft 96 that is welded at one end to the lower mast member 42.

To permit adjustment of the position of the sleeve 95 along the guide shaft 96, a control rod 98 is connected at one end to a second, horizontal pin 99 on the sleeve 95, and at a second end to the bottom of an actuating arm 100. The actuating arm 100 is pivotally mounted to a bracket 102 connected to the horizontal cross member 18. Disposed at the top end of the actuating arm 100 is an actuating handle 104 which can be used to move the actuating arm 100 along a guide track 106 that is attached to the upper mast 44. The guide track 106 is preferably formed from small diameter metal round stock and includes a first notch 108 for securing the adjustment arm 100 in the fully opened position where the rear inner members 24 of the side members 16 are spread apart as illustrated best in FIG. 3, and a second notch 110 for securing the adjustment arm 100 in the fully closed position where the side members 16 are held parallel to one another as best illustrated in FIG. 5.

To allow a care giver or other assistant to aid in maneuvering the lift walker 10, a T-shaped assisting handle 112 is attached to the front side of the boom bracket 48. A weight gauge 114 is also attached to the boom bracket 48 which can be employed to determine how much weight is bearing down on the handles 66 and the hooks 70. The weight gauge 114 is useful in physical therapy when it is desired to adjust the position of the yoke arms 52 so that a certain percentage of the individual's weight is supported by the ALSW device 10. The weight sensing elements (not shown) for the weight gauge 114 can be of any conventional type which generate an electrical output, such as strain gauge types, and are preferably affixed to the top portion 68 of the yoke arm 52.

Figure 6:
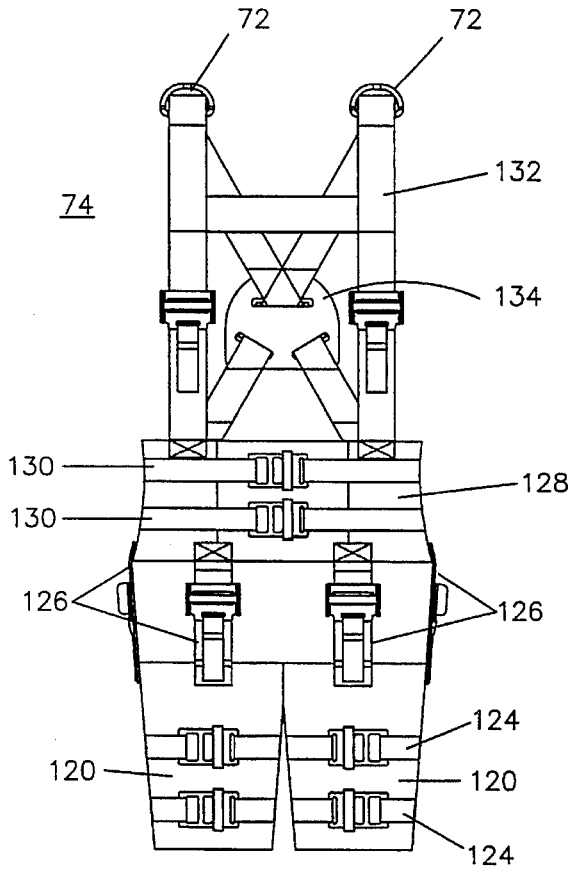
FIG. 6 is a front view of a full body harness employed with the preferred embodiment; and, FIG. 7 is a back view of the full body harness.
Figure 7:
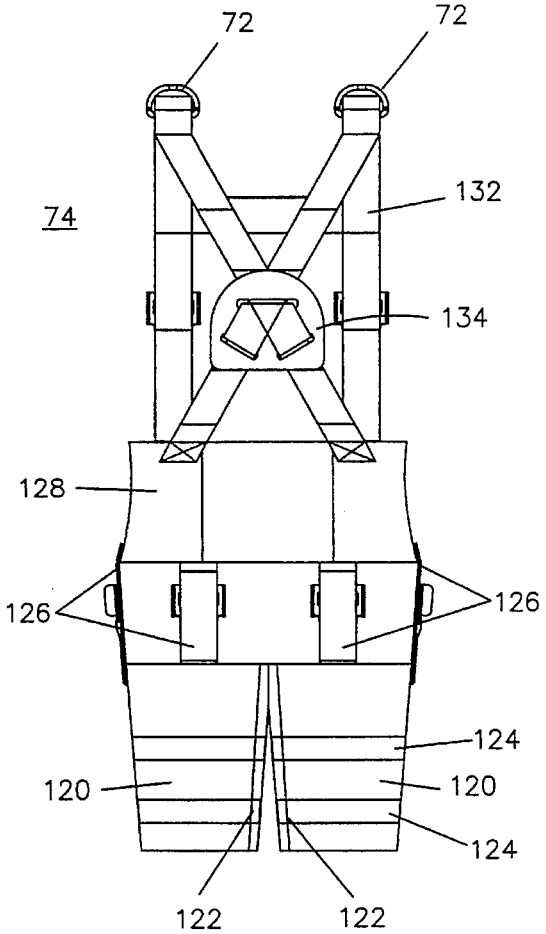

Turning now to FIGS. 6 and 7, the full body harness 74 is shown in greater detail. In particular, the harness 74 includes first and second elongated padded thigh wraps 120, one for each of an individual's thighs. Each of the thigh wraps 120 is designed to have a conical shape when wrapped around an individual's thigh which helps prevent them from sliding up toward the groin area during lifting. Preferably, each of the thigh wraps 120 has a substantial height in the range of between 5 and 12 inches, depending upon the size of the individual, which provides a large surface area for distribution of the lifting pressure that eliminates pressure point pain during patient lifting. Each of the thigh wraps 120 includes a vertical seam 122 having a conventional Velcro fastener (not shown). A pair of adjustable straps 124 are also provided which in combination with the Velcro fastener, enable each of the thigh wraps 120 to be secured firmly to an individual's thighs.

Each of the thigh wraps 120 is connected by a pair of corresponding adjustable vertical straps 126 to a padded lumbar support belt 128. The lumbar support belt 128 includes a pair of straps 130 for securing the belt 128 around a person's trunk. The full body harness 74 employs the lumbar support belt 128 to provide safe assistance to those individuals requiring external back support during standing or walking while utilizing the ALSW device 10. The lumbar support belt 128 also assists in lift pressure distribution in the trunk in much the same manner that the thigh wraps 120 distribute lift pressure in the thighs. Finally, a plurality of conventional shoulder and other straps 132 and a strap junction 134 form the top portion of the full body harness 74 with the "D" rings 72 being attached to the upper shoulder straps thereof.

During operation, the ALSW device 10 is first positioned with the yoke arms 52 in the fully lowered or nearly fully lowered position as illustrated in FIG. 4. In the fully lowered position, the hooks 70 are low enough to the ground that they can be easily attached to the "D" rings 72 of the full body harness 74 when it is secured to an individual lying on the ground or floor. The hydraulic jack 80 can then be actuated to lift the person off of the floor and into a standing position as illustrated in FIG. 1. The final height of the rings 70 can be adjusted as desired to unload a portion of the individual's body weight as indicated by the weight gauge 114 if the individual is unable to bear all of their weight on their feet. The yoke arms 52 can also be individually adjusted relative to one another so that the rings 70 are at different heights to accommodate individuals with posture problems or requiring particular positioning for rehabilitation therapy.

Figure 3:
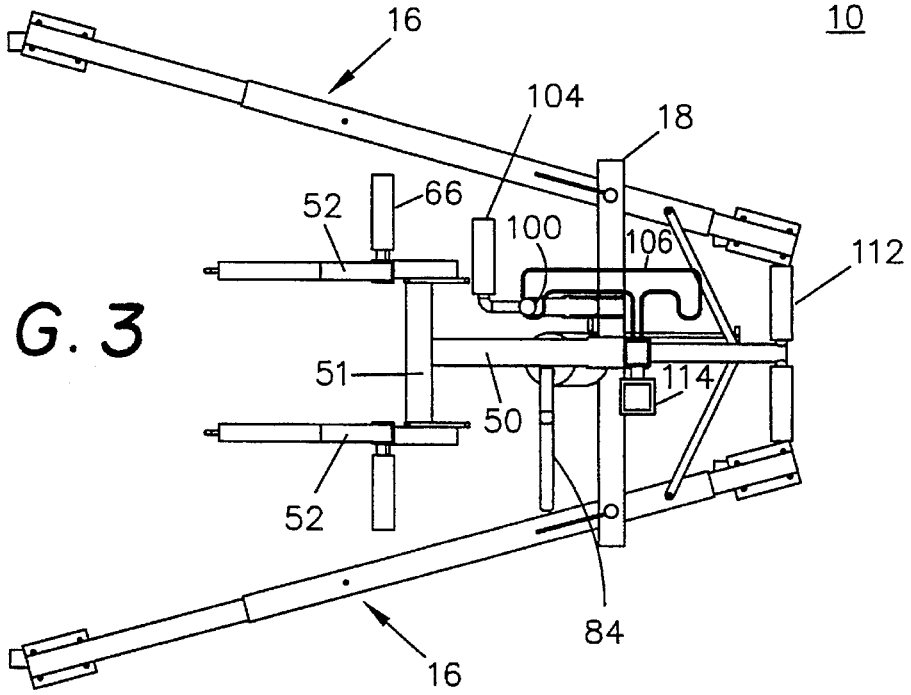
FIG. 3 is a top view of the preferred embodiment shown in the first position.

If the individual desiring to use the ALSW device 10 is initially in a wheelchair, the side members 16 are spread apart as illustrated in any of FIGS. 1–3 so that the wheelchair can be rolled between them and the individual can take hold of the yoke arm handles 66. The yoke arms 52 will be positioned somewhere between the fully raised and fully lowered positions illustrated in FIGS. 2 and 4 so that the height of the rings 70 will be suitable for attachment to the body harness 74 when placed on the individual in the wheelchair. Once the yoke arms 52 are elevated to their fully raised position and the individual is standing as illustrated in FIG. 1, the wheelchair is backed away from the ALSW device 10, and then the side members 16 are moved to the closed position as illustrated in FIG. 5 through manipulation of the adjustment arm 100. In this position, the overall width of the ALSW device 10 is reduced enough that it can pass through any passageway meeting the minimum width requirements of the Americans With Disabilities Act.

Alternatively, the individual desiring to use the ALSW device 10 can be facing in the opposite direction away from the yoke arms 52 if the individual desires to use some form of stationary exercise equipment, such as a treadmill or bicycle, for example. In this instance, the individual is lifted as before by means of the body harness 74, and the ALSW device 10 is moved adjacent the piece of exercise equipment so that the individual can use the same while still being supported by the body harness 74. This enables severely handicapped individuals to use exercise equipment who normally could not do so.

In summary, the ALSW device 10 overcomes the drawbacks of prior art devices through use of its many adjustable elements. In particular, the adjustable rear track width of the base frame 14 enables the ALSW device 10 to negotiate narrow passageways, while at the same time permitting easy access to the device by individuals confined to wheelchairs or beds, for example. The adjustability of the lifting yoke arms 52 through use of the adjustable boom 50 and hydraulic jack 80 permit the ALSW device 10 to be employed for lifting individuals from a prone position on the floor all the way to a standing position. In addition, this wide range of adjustments also facilitates easy storage and transport of the device, as well as easy maneuverability and use of the device in small spaces with low vertical clearances, such as doorways, thereby providing increased accessibility for the disabled. The individually adjustable angular and vertical position of the yoke arms 52 also facilitate use of the ALSW device 10 with individuals requiring special positioning for assistance or rehabilitation therapy. The particular design of the yoke arms 52 also minimizes the possibility of injury occurring during use of the device. Finally, the special design of the full body harness 74 provides better support and increased comfort for the individual.

Although the present invention has been disclosed in terms of a preferred embodiment, it will be understood that numerous variations and modifications could be made thereto without departing from the scope of the invention as set forth in the following claims.

What is claimed is:

1. An assisted lifting, standing and walking device comprising:

a base frame;

a plurality of wheels attached to said base frame for permitting it to roll freely;

a vertical frame assembly attached to said base frame, said vertical frame assembly including:

a vertical mast assembly connected at a bottom end to said base frame and having a top end; and, a boom member pivotally connected at a first end to the top end of said vertical mast assembly for movement about a horizontal axis;

first and second generally L-shaped lifting yoke arms adjustably attached to a second end of said boom member, each said lifting yoke arm having a handle disposed at a first end and a lifting hook for attachment to a body harness disposed at a second, opposite end; and, a lifting mechanism attached to said boom member for adjusting the position of said boom member relative to said vertical mast assembly.

2. The device of claim 1, wherein said first and second lifting yoke arms are attached to opposite ends of a horizontal cross member disposed at said second end of said boom member, and include means to individually adjust their angular and vertical position with respect to said boom member.

3. The device of claim 1, wherein said lifting mechanism comprises a hydraulic jack having an extensible ram connected to said boom member.

4. The device of claim 1, wherein said second ends of said first and second lifting yoke arms are adjustable between a first position wherein said lifting hooks are lowered to a position less than approximately one foot above a surface on which the device is placed to facilitate attachment of said lifting hooks to a body harness positioned on an individual in a prone position on said surface, and a second, raised position wherein said lifting hooks are elevated to a height sufficient to support an individual in a standing position.

5. The device of claim 1, further including a full body harness for supporting an individual and being connectable to said lifting hooks on said first and second lifting yoke arms, said full body harness including first and second conically shaped elongated thigh wraps.

6. The device of claim 5, wherein each of said elongated thigh wraps has a length in the range of approximately 5–12 inches.

7. An assisted lifting, standing and walking device comprising:

a base frame including:

first and second spaced horizontal side members, each said horizontal side member having a first end and a second end; and means for adjusting the distance between the second ends of said first and second spaced horizontal side members;

a plurality of wheels attached to said base frame for permitting it to roll freely;

a vertical frame assembly attached to said base frame at a bottom end and having a top end, said vertical frame assembly including:

a vertical mast assembly having a bottom end connected to said base frame, and having a top end;

a boom member having a first end connected to the top end of said vertical mast assembly for movement about a horizontal axis, and having a second end;

first and second generally L-shaped lifting yoke arms adjustably attached to said second end of said boom member, each said lifting yoke arm having a handle disposed at a first end and a lifting hook disposed at a second, opposite end for attachment to a lifting and supporting harness; and a lifting mechanism attached to said boom member for adjusting the position of said boom member relative to said vertical mast assembly.

8. The device of claim 7, wherein said base frame further includes a horizontal cross member, and said means for adjusting the distance between the rear ends of said first and second spaced horizontal side members comprises:

first means for pivotally attaching the first of said side members to a first end of said cross member for movement about a vertical axis;

second means for pivotally attaching the second of said side members to a second, opposite end of said cross member for movement about a vertical axis; and, an adjustment linkage attached to said first and second spaced horizontal side members for selectively adjusting the distance between the rear ends of said side members.

9. The device of claim 8, wherein each of said first and second horizontal side members of said base frame further comprises:

a middle sleeve having a front end and a rear end;

a front inner member telescopically inserted and secured in said front end of said middle sleeve; and, a rear inner member telescopically inserted and secured in said rear end of said middle sleeve.

10. The device of claim 9, wherein said rear inner member further includes means for securing said rear inner member in said rear end of said middle sleeve in any one of a plurality of different positions.

11. The device of claim 8, wherein said adjustment linkage includes:

first and second adjustment arms, each pivotally attached at a first end to a corresponding one of said first and second side members, and both being attached at a second end to a reciprocating member; and, an actuating mechanism connected to said reciprocating member for reciprocating the same and thereby causing said first and second horizontal side members to pivot in opposite directions about said first and second means for pivotally, respectively, said actuating mechanism including an actuating arm and a handle attached to said actuating arm at a position which enables an individual using said device to actuate said actuating mechanism;

whereby, the distance between said first and second horizontal side members is adjustable by said actuating mechanism.

12. The device of claim 7, further including a full body harness for supporting an individual and being connectable to said means for attaching to said top end of said vertical frame assembly, said full body harness including first and second conically shaped elongated thigh wraps.

13. The device of claim 12, wherein each of said elongated thigh wraps has a length in the range of approximately 5–12 inches.

14. The device of claim 12, wherein said full body harness further includes a lumbar support belt.

15. The device of claim 7, wherein said first and second lifting yoke arms are attached to opposite ends of a horizontal cross member disposed at said second end of said boom member, and include means for individually adjusting their angular and vertical position with respect to said boom member.

16. The device of claim 7, wherein said lifting mechanism comprises a hydraulic jack having an extensible ram connected to said boom member.

17. An assisted lifting, standing and walking device comprising:

a base frame including:

first and second spaced horizontal side members, each said horizontal side member having a first end and a second end; and means for adjusting the distance between the second ends of said first and second spaced horizontal side members;

a plurality of wheels attached to said base frame for permitting it to roll freely;

a vertical frame assembly attached to said base frame at a bottom end and having a top end;

a full body harness for supporting an individual, said full body harness including first and second conically shaped elongated thigh wraps for applying distributed lifting pressure evenly over the thighs of an individual and preventing movement of said thigh wraps toward an individual's groin area; and strap means connected to said first and second thigh wraps and attachable to an individual's torso; and means for attaching said lifting and supporting harness to said top end of said vertical frame assembly for lifting and supporting an individual.

18. The device of claim 17, wherein each of said elongated thigh wraps has a length in the range of approximately 5–12 inches.

19. The device of claim 17, wherein said full body harness further includes a lumbar support belt connected to said strap means.

20. An assisted lifting, standing and walking device comprising:

a base frame including:

first and second spaced horizontal side members, each said horizontal side member having a first end and a second end;

a horizontal cross member having a first end and a second end;

first means for pivotally attaching the first of said side members to said first end of said cross member for movement about a vertical axis;

second means for pivotally attaching the second of said side members to said second end of said cross member for movement about a vertical axis;

first and second adjustment arms, each pivotally attached at a first end to a corresponding one of said first and second side members, and both being attached to the second end to a reciprocating member; and an actuating mechanism connected to said reciprocating member for reciprocating the same and thereby causing said first and second horizontal side members to pivot in opposite directions about said first and second means for pivotally attaching, respectively, said actuating mechanism including a vertical actuating arm with a horizontal handle disposed at a top end thereof at a position which enables an individual being supported by said device to actuate said actuating mechanism and thereby adjust the distance between said first and second horizontal side members;

a plurality of wheels attached to said base frame for permitting said base frame to roll freely;

a vertical frame assembly attached to said base frame at a bottom end and having a top end;

means for attaching a lifting and supporting harness to said top end of said vertical frame assembly for lifting and supporting an individual; and a full body harness for supporting an individual and being connectable to said means for attaching to said top end of said vertical frame assembly, said full body harness including first and second conically shaped elongated thigh wraps for applying distributed lifting pressure evenly over the thighs of an individual and preventing movement of said thigh wraps toward an individual's groin area; and, strap means connected to said first and second thigh wraps and attachable to an individual's torso.

21. The device of claim 20, wherein each of said elongated thigh wraps has a length in the range of approximately 5–12 inches.

22. The device of claim 20, wherein said full body harness further includes a lumbar support belt connected to said strap means.

23. A full body harness for providing body weight support of an individual comprising:

first and second conically shaped elongated thigh wraps for applying distributed lifting pressure evenly over the thighs of an individual and preventing movement of said thigh wraps toward an individual's groin area;

strap means connected to said first and second thigh wraps and attachable to an individual's torso, said strap means including a plurality of shoulder straps for being positioned over an individual's shoulder; and means for attaching said plurality of shoulder straps to a device for supporting said full body harness.

24. The full body harness of claim 23, wherein each of said elongated thigh wraps has a length in the range of approximately 5–12 inches.

25. The full body harness of claim 23, further including a lumbar support belt attached to said strap means.

* * * * *